US008109248B2

(12) United States Patent
Lyo et al.

(10) Patent No.: US 8,109,248 B2
(45) Date of Patent: Feb. 7, 2012

(54) VALVE LIFTER AND SURFACE TREATMENT METHOD THEREOF

(75) Inventors: In Woong Lyo, Suwon-Si (KR); Sung Moom Choi, Suwon-Si (KR); Woong Kim, Hwaseong-Si (KR); Jeong Uk An, Dongjak-gu (KR); Hyung Ick Kim, Gunpo-Si (KR); Seung Gyun Ahn, Gangseo-gu (KR); Hong Kil Baek, Gangnam-gu (KR); Jin Won Jung, Gwacheon-Si (KR)

(73) Assignees: Hyundai Motor Company, Seoul (KR); Kia Motors Corporation

( * ) Notice: Subject to any disclaimer, the term of this patent is extended or adjusted under 35 U.S.C. 154(b) by 577 days.

(21) Appl. No.: 12/291,120

(22) Filed: Nov. 5, 2008

(65) Prior Publication Data

US 2010/0012064 A1 Jan. 21, 2010

(30) Foreign Application Priority Data

Jul. 18, 2008 (KR) ..... 10-2008-0070306

(51) Int. Cl.
*F01L 1/14* (2006.01)

(52) U.S. Cl. ..... 123/90.51; 123/90.52; 74/569

(58) Field of Classification Search ..... 123/90.51, 123/90.52, 90.48; 74/569; 428/698
See application file for complete search history.

(56) References Cited

U.S. PATENT DOCUMENTS

| | | | | |
|---|---|---|---|---|
| 6,571,865 | B1 * | 6/2003 | Shi et al. | 165/133 |
| 6,844,068 | B1 | 1/2005 | Miyake et al. | |
| 7,255,084 | B2 * | 8/2007 | Savale et al. | 123/193.6 |
| 2005/0098134 | A1 | 5/2005 | Nishimura et al. | |
| 2006/0207540 | A1 * | 9/2006 | Matsui et al. | 123/90.49 |

FOREIGN PATENT DOCUMENTS

| | | |
|---|---|---|
| JP | 2005-090489 | 4/2005 |
| KR | 2007-0016818 | 2/2007 |

* cited by examiner

*Primary Examiner* — Zelalem Eshete
(74) *Attorney, Agent, or Firm* — Edwards Wildman Palmer LLP; Peter F. Corless

(57) ABSTRACT

The present invention provides a valve lifter, including a buffer layer, a Me diamond-like carbon layer having a thickness of 0.3~0.6 μm, and a diamond-like carbon layer having a thickness of 1~1.5 μm and a SP3 bonding fraction of 60~70%, which are sequentially formed on a base body which is subjected to carbonitriding treatment. The valve lifter can exhibit superior low-friction characteristics and wear resistance.

9 Claims, 7 Drawing Sheets

VALVE LIFTER AND SURFACE TREATMENT METHOD THEREOF

CROSS-REFERENCE TO RELATED APPLICATIONS

This application claims under 35 U.S.C. §119(a) priority to Korean Application No. 10-2008-0070306, filed on Jul. 18, 2008, the disclosure of which is incorporated herein by reference in its entirety.

BACKGROUND

1. Technical Field

The present invention relates to a valve lifter for an automotive internal combustion engine and a surface treatment method thereof.

2. Background Art

A valve lifter for converting the revolution of a camshaft into a vertical movement is mainly formed of alloy cast iron or carbon steel.

As shown in FIG. 1 and FIG. 2, a valve lifter 20 has a cylindrical structure, and the top surface 21 thereof is always in contact with a camshaft 10 that revolves, thereby being continuously subject to friction. In order to reduce such friction, the surface, in particular, the top surface 21, of the valve lifter 20, is typically subjected to mirror surface finishing, diamond-like carbon (DLC) coating, or CrN (Chromium Nitride) coating.

However, the mirror surface finishing does not provide satisfactory surface roughness. The DLC or CrN coating shows low-friction characteristics. The DLC or CrN coating thus requires a specially designed oil to exhibit optimal low-friction characteristics, as disclosed in US Patent Application Publication No. 2005/0098134.

The above information disclosed in this the Background section is only for enhancement of understanding of the background of the invention and therefore it may contain information that does not form the prior art that is already known in this country to a person of ordinary skill in the art.

SUMMARY OF DISCLOSURE

Accordingly, the present invention has been made keeping in mind the above problems occurring in the related art, and the present invention provides a valve lifter having superior low-friction characteristics, without the need to use a specially designed oil, and also provides a surface treatment method used in the manufacture of such a valve lifter.

According to one aspect of the present invention, a valve lifter may comprise a plurality of coating layers formed on the surface thereof to exhibit low-friction characteristics, wherein a top coating layer among the plurality of coating layers is a DLC layer having a SP3 bonding fraction of 60~70%.

According to another aspect of the present invention, a valve lifter may a buffer layer formed by sputtering a metal target on a surface of the base body, which surface is subjected to carbonitriding treatment; an Me diamond-like carbon layer having a thickness of 0.3~0.6 μm and formed by sputtering a target selected from the group consisting of W, Cr, Ti, and Mo on the buffer layer; and a diamond-like carbon layer formed on the Me diamond-like carbon layer, having a thickness of 1~1.5 μm, and having a SP3 bonding fraction of 60~70%.

Preferably, the base body, which is subjected to carbonitriding treatment, has a surface roughness (Ra) of 0.01~0.04, and the buffer layer is a Cr coating layer formed by sputtering a Cr target.

Further, the DLC layer may have hydrogen content of 5~15 wt % and a hardness of 28~32 Gpa.

According to a further aspect, a method of treating the surface of the valve lifter may comprise: (a) carbonitriding and tempering a surface of a base body; (b) surface finishing the base body to produce a surface roughness (Ra) of 0.01~0.04; (c) forming a metal buffer layer on the base body and then forming an Me diamond-like carbon layer with a thickness of 0.3~0.6 μm on the metal buffer layer by sputtering a target selected from the group consisting of W, Cr, Ti, and Mo; and (d) forming a diamond-like carbon layer with a SP3 bonding fraction of 60~70% and a thickness of 1~1.5 μm on the Me diamond-like carbon layer.

The DLC layer may be formed by sputtering a graphite target, and the SP3 bonding fraction may be controlled by adjusting an amount of acetylene ($C_2H_2$) which is supplied and a magnitude of a bias voltage applied to a jig on which the valve lifter is to be mounted.

Preferably, the buffer layer is formed by sputtering a Cr target. Further, in the step (a), the tempering may be conducted at a temperature of 200~250° C., and, in the steps (c) and (d), the coating layers are formed at a temperature maintained at 250° C. or lower.

BRIEF DESCRIPTION OF THE DRAWINGS

FIG. 8 is a photograph showing the results of observation of wear scars of the valve lifter according to an example of the present invention, after a durability test.

DETAILED DESCRIPTION

Hereinafter, a detailed description will be given of a valve lifter and a surface treatment method thereof, with reference to the appended drawings.

Figure 1:
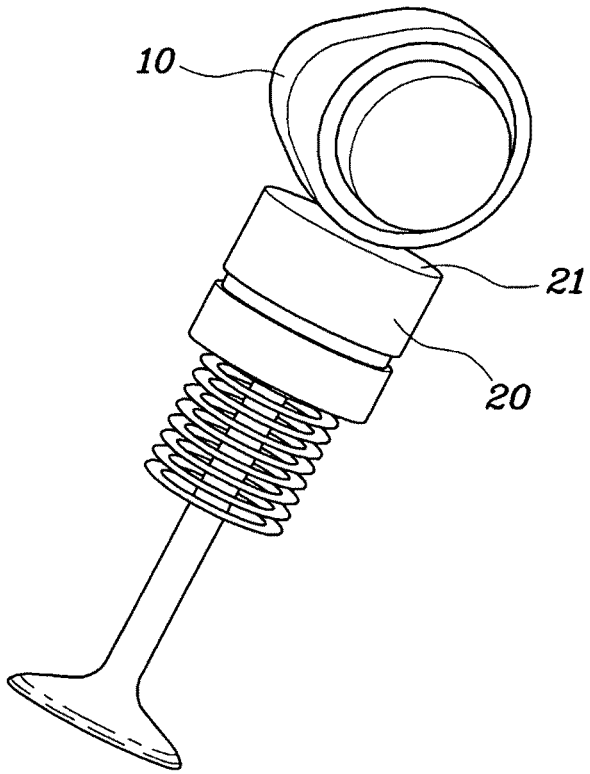
FIG. 1 is a view showing part of a valve train system for a typical internal combustion engine.
Figure 2:
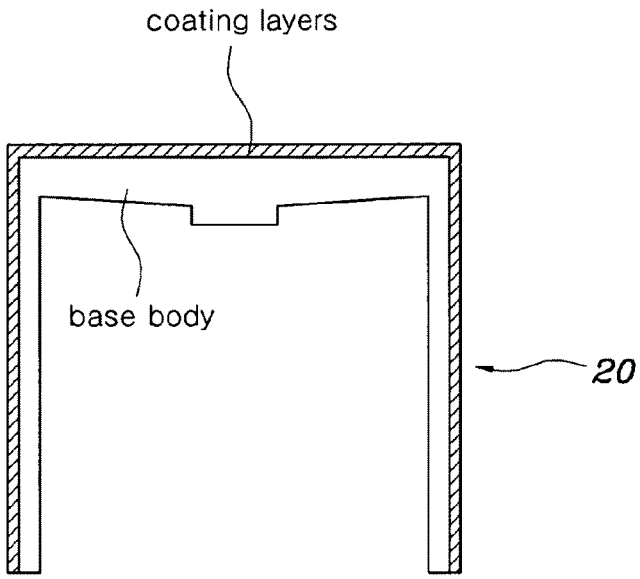
FIG. 2 is a sectional view of a valve lifter according to an example of the present invention.
Figure 3:
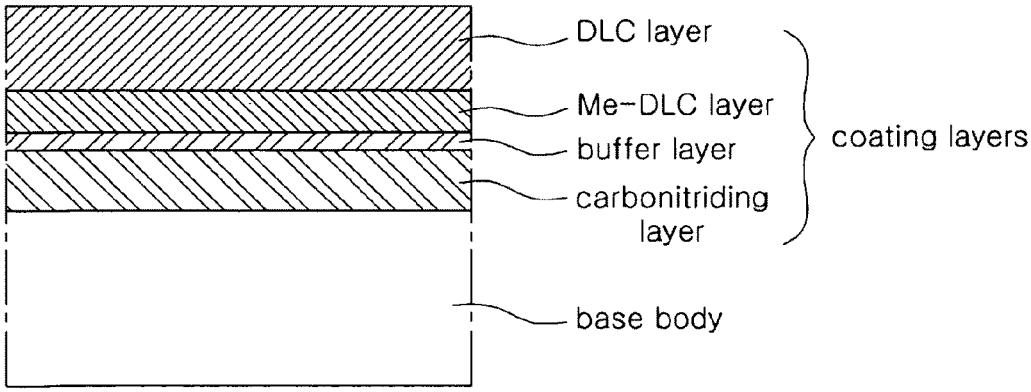
FIG. 3 is a view showing coating layers according to the present invention.

As shown in FIGS. 2 and 3, a valve lifter 20 has a plurality of coating layers on the outer surface thereof, in particular on the top surface thereof, in order to exhibit low-friction characteristics. Such coating layers are directly formed on the surface of the valve lifter 20, or alternatively, may be formed on a shim which is additionally provided over the top surface of the valve lifter 20 which comes into contact with a camshaft. The coating layers may comprise a buffer layer, a metal-containing DLC layer ("Me-DLC layer"), and a DLC layer, which are sequentially formed on a base body which is carbonitrided.

With reference to FIGS. 3, 4, 5A and 5B, the above coating layers and the method of treating the surface of the valve lifter are described below.

First, the valve lifter is subjected to surface pretreatment before the surface thereof is coated.

For hardening and stabilization of the base body on which the coating layers are to be formed, carbonitriding is performed. That is, the surface of the base body is carbonitrided and then tempered at 200∞250° C. The surface of the base body which is carbonitrided is subjected to surface finishing to bring a surface roughness (Ra) to 0.01~0.04 μm. If the surface roughness of the base body is less than 0.01 μm, the roughness is rather increased by the surface coating of the base body, undesirably resulting in excessive costs relative to produced effects. Conversely, if the surface roughness exceeds 0.04 μm, friction reduction effects are decreased due to the roughness of the coating layers. The surface finishing of the base body may be conducted through buffing, vibration finishing (VF), super finishing (SF), etc.

Next, the thus-obtained surface of the base body is coated.

In order to increase the force of adhesion of the base body to the coating layers formed thereon, a buffer layer is formed on the surface of the base body which is subjected to surface pretreatment. The buffer layer may be formed of Cr, Ti or the like. In particular, the effect of a Cr coating layer formed by sputtering a Cr target is better.

The surface of the base body having the buffer layer formed thereon is subjected to PACVD (Plasma Assisted Chemical Vapor Deposition) using acetylene as a carbon source, thus forming an Me-DLC layer. Specifically, the Me-DLC layer is formed by sputtering a metal target while supplying acetylene ($C_2H_2$) as a reactive gas to the surface of the base body. Examples of the metal target include W, Cr, Ti, and Mo. Particularly useful is W or Cr. The Me-DLC layer, functioning to increase impact resistance and the force of adhesion between the base body and the top DLC layer which exhibits low-friction characteristics, is deposited to a thickness of 0.3~0.6 μm. If the thickness of the Me-DLC layer is less than 0.3 μm, impact resistance and force of adhesion are not adequately obtained. Conversely, if the thickness of the Me-DLC layer exceeds 0.6 μm, residual stress of the Me-DLC layer itself is increased, undesirably decreasing the effect of the Me-DLC layer.

On the Me-DLC layer, a DLC layer which actually exhibits low-friction characteristics is formed to a thickness of 1.0~1.5 μm. If the thickness of the DLC layer is less than 1.0 μm, the DLC layer wears and disappears in the course of initial operation of an internal combustion engine. Conversely, if the thickness exceeds 1.5 μm, residual stress of the DLC layer itself is increased and thus the DLC layer peels off.

Figure 4:
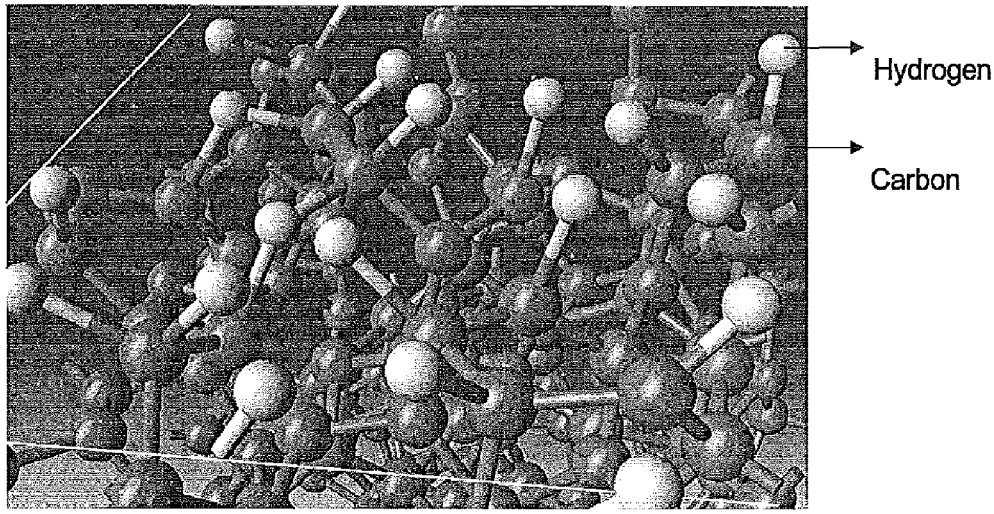
FIG. 4 is a view showing a carbon bonding structure of a DLC layer of FIG. 2.
Figure 5A:
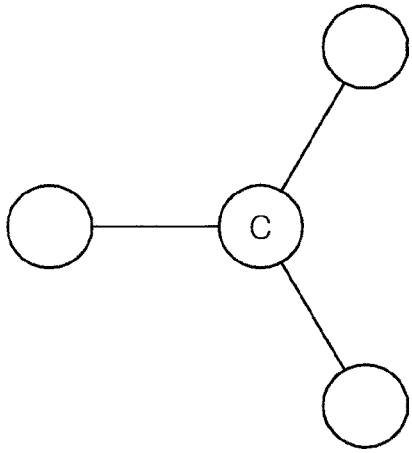
FIG. 5A is a view showing the SP2 bonding of the carbon bonding structure of FIG. 4.
Figure 5B:
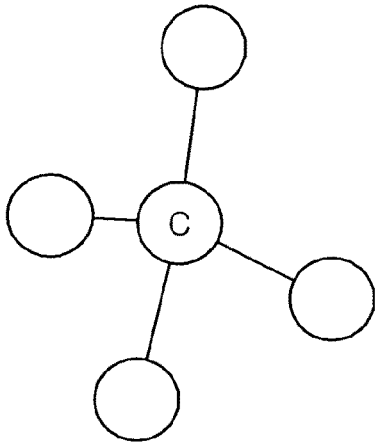
FIG. 5B is a view showing the SP3 bonding thereof.

The DLC layer is formed by sputtering a graphite target while supplying acetylene. As shown in FIG. 4, the DLC layer has a hybridization structure of SP2 bonding (FIG. 5A) and SP3 bonding (FIG. 5B), in which carbon or hydrogen is attached to carbon. When the SP3 bonding fraction is 60~70%, the greatest low-friction characteristics are exhibited. If the SP3 bonding fraction is less than 60%, hardness of the DLC layer is drastically lowered and thus the surface of the valve lifter undesirably wears down. Conversely, if the SP3 bonding fraction exceeds 70%, inherent low-friction characteristics of the DLC layer are remarkably decreased. For reference, a DLC layer formed through PACVD has a SP3 bonding fraction of 70~80%, and a DLC layer formed through PVD (Physical Vapor Deposition) has a SP3 bonding fraction of at least 80%.

The SP3 bonding fraction is controlled by precisely supplying acetylene and adjusting a bias voltage which is applied to a jig on which the valve lifter is mounted. The SP3 bonding fraction of the DLC layer is in proportion to an amount of hydrogen that is supplied and is in inverse proportion to a magnitude of a bias voltage. In consideration of only low-friction characteristics of the DLC layer, acetylene should be supplied in a small amount and a high bias voltage should be applied. However, the hardness of the DLC layer also depends on the bias voltage and is maximized at a specific bias voltage. Experimentally, only when the optimal value is obtained in joint consideration of the hardness and the SP3 bonding fraction, the DLC layer which is superior in both wear resistance and low-friction characteristics can be formed.

Figure 6:
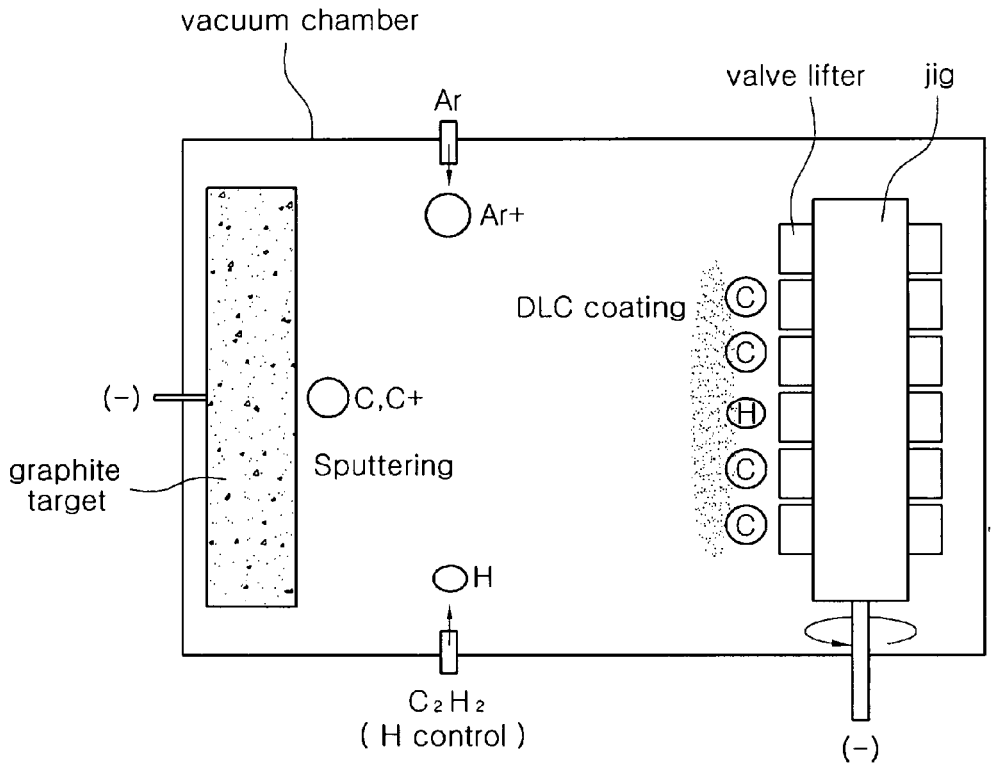
FIG. 6 is a schematic view showing an apparatus used in the formation of the DLC layer of FIG. 2.

With reference to FIG. 6, in a PVD apparatus for forming the DLC layer, a graphite target is located in a vacuum chamber and the valve lifter is spaced apart from the graphite target by a predetermined distance. A bias voltage (−) is applied to the graphite target, and a bias voltage (−Vsb) is applied to a jig on which the valve lifter is mounted. To one side of the vacuum chamber, argon is supplied to collide with the graphite target to which a negative bias has been applied to thus generate sputtering, and acetylene is supplied to the other side thereof for hydrogen control. Using such an apparatus, when the magnitude of the bias voltage applied to the jig and the amount of acetylene that is supplied are adjusted and the SP3 bonding fraction of the DLC layer is controlled to be at least 80%, the DLC layer contains 5~15 wt % of hydrogen. Further, the hardness of the DLC layer is about 28~32 Gpa. For reference, a DLC layer formed through PACVD has a hydrogen content of about 25~30 wt %, and a DLC layer formed through PVD has a hydrogen content of about 0~5%.

In order to check the low-friction characteristics of the valve lifter coated by the above surface treatment method, six valve lifters formed of the same material were manufactured, each of which was subjected to surface treatment as shown in Table 1 below and then subjected to a friction torque test.

TABLE 1

| | Heat Treatment of Base body | Surface Roughness (Ra) | Top Coating Layer | SP3 Fraction |
|---|---|---|---|---|
| C. Ex. 1 | Carbonizing | 0.1 | — | — |
| C. Ex. 2 | Carbonizing | 0.03 | — | — |
| C. Ex. 3 | Carbonitriding | 0.1 | DLC | 75% |
| C. Ex. 4 | Carbonitriding | 0.03 | DLC | 75% |
| C. Ex. 5 | Carbonitriding | 0.03 | DLC | 82% |
| Ex. | Carbonitriding | 0.03 | DLC | 64% |

In Comparative Examples 1 and 2, only surface pretreatment was conducted, and in Comparative Examples 3 to 5 and Example of the present invention, surface pretreatment and multi-coating (buffer layer, Me-DLC layer, DLC layer) were conducted. The surface roughness of the base body and the SP3 bonding fraction of the DLC layer as a top coating layer, in Comparative Example 3, and the SP3 bonding fraction of the DLC layer in Comparative Examples 4 and 5, fell outside of the ranges according to the present invention. In the Example of the present invention, the valve lifter was manufactured within the ranges according to the present invention, and the SP3 bonding fraction of the DLC layer was 64%.

Each of the valve lifters of Comparative Examples 1 to 5 and the example was subjected to a rig test using an engine head system. The test conditions are shown in Table 2 below, and the test results are graphed in FIG. 7.

TABLE 2

| | |
|---|---|
| Test Engine | 2 l Inline 4-Cylinder Head |
| Valve Lifter | Direct Acting Type |
| Rig Type | Motoring |
| Engine Speed | 800~6000 rpm |
| Oil & Cooling Water Temp. | 90° C. |
| Oil Pressure | 1 bar |
| Oil | 5W20 |

Figure 7:
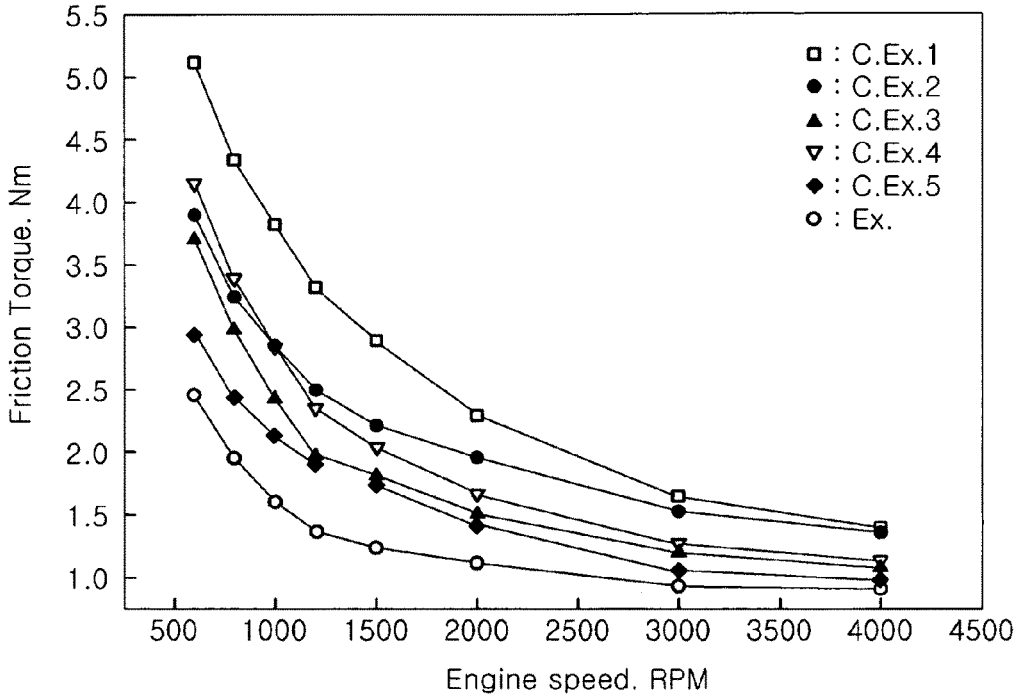
FIG. 7 is a graph showing the results of friction testing the valve lifters according to an example of the present invention in conjunction with comparative examples.
Figure 9:
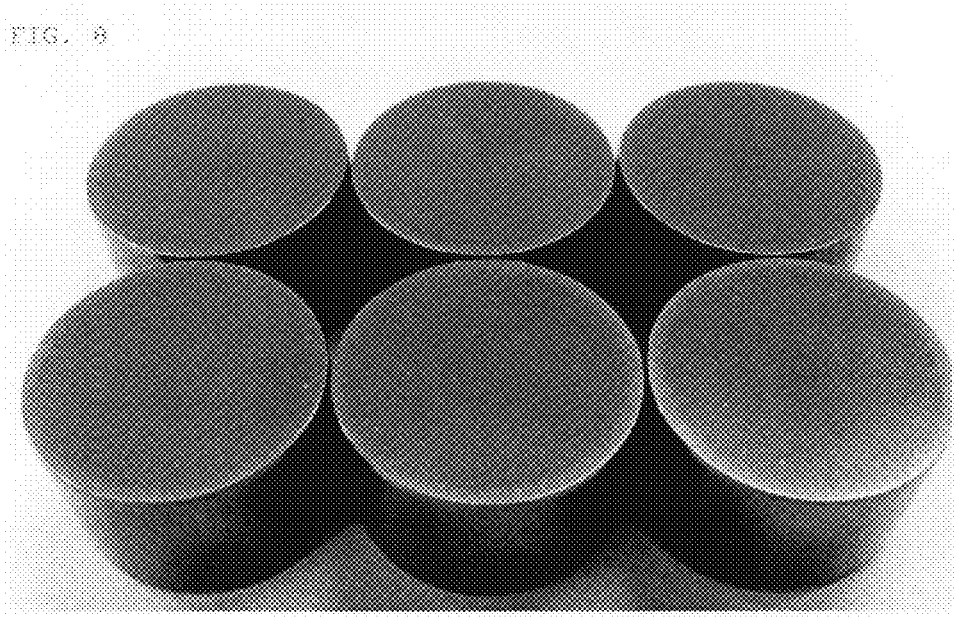

In the graph of FIG. 7, a transverse axis indicates an engine speed (rpm) and a longitudinal axis indicates a friction torque (Nm). In Example of the present invention, low-friction characteristics were much higher than those of Comparative Examples 1 to 3, and further, higher friction reduction effects were exhibited compared to Comparative Examples 4 and 5 in which only the SP3 bonding fraction of the DLC layer was different.

Further, the valve lifter of the example was mounted to an actual engine, and a 500 hour durability test was conducted, after which wear scars of the surface of the valve lifter were observed. As is apparent from FIG. 8, in the valve lifter of Example, having high wear resistance, almost no wear scars were observed.

As described above, the present invention provides a valve lifter and a surface treatment method thereof. According to the present invention, the valve lifter can exhibit superior low-friction characteristics, without the conventional need to use oil under specific conditions. Further, the valve lifter according to the present invention can manifest superior wear resistance.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A valve lifter comprising a base body and coating layers provided on the base body, the coating layers including:

a buffer layer formed by sputtering a metal target on a surface of the base body, which surface is subjected to carbonitriding treatment;

an Me diamond-like carbon layer having a thickness of 0.3~0.6 μm and formed by sputtering a target selected from the group consisting of W, Cr, Ti, and Mo on the buffer layer; and a diamond-like carbon layer formed on the Me diamond-like carbon layer, having a thickness of 1~1.5 μm, and having a SP3 bonding fraction of 60~70%.

2. The valve lifter as set forth in claim 1, wherein the base body, which is subjected to carbonitriding treatment, has a surface roughness (Ra) of 0.01~0.04.

3. The valve lifter as set forth in claim 1, wherein the buffer layer is a Cr coating layer formed by sputtering a Cr target.

4. The valve lifter as set forth in claim 1, wherein the diamond-like carbon layer has a hydrogen content of 5~15 wt % and a hardness of 28~32 Gpa.

5. A method of surface treating a valve lifter, comprising:

(a) carbonitriding and tempering a surface of a base body;

(b) surface finishing the base body to produce a surface roughness (Ra) of 0.01~0.04;

(c) forming a metal buffer layer on the base body and then forming an Me diamond-like carbon layer with a thickness of 0.3~0.6 μm on the metal buffer layer by sputtering a target selected from the group consisting of W, Cr, Ti, and Mo; and (d) forming a diamond-like carbon layer with a SP3 bonding fraction of 60~70% and a thickness of 1~1.5 μm on the Me diamond-like carbon layer.

6. The method as set forth in claim 5, wherein the diamond-like carbon layer is formed in the step (d) by sputtering a graphite target, and the SP3 bonding fraction is controlled by adjusting an amount of acetylene ($C_2H_2$) and a magnitude of a bias voltage applied to a jig on which the valve lifter is to be mounted.

7. The method as set forth in claim 5, wherein the buffer layer is formed by sputtering a Cr target.

8. The method as set forth in claim 5, wherein in the step (a), the tempering is conducted at a temperature of 200~250° C.

9. The method as set forth in claim 5, wherein in the steps (c) and (d), the processes for forming the buffer layer, the Me diamond-like carbon layer, and the diamond-like carbon layer are conducted with a coating temperature maintained at 250° C. or lower.

* * * * *